United States Patent [19]

Ives

[11] 4,163,335

[45] Aug. 7, 1979

[54] BLACK POWDER FIRING NIPPLE

[75] Inventor: Robert K. Ives, Portland, Oreg.

[73] Assignee: Michaels of Oregon Co., Portland, Oreg.

[21] Appl. No.: 924,611

[22] Filed: Jul. 14, 1978

[51] Int. Cl.[2] ..... F41C 27/00

[52] U.S. Cl. ..... 42/83; 42/51

[58] Field of Search ..... 42/83, 51

[56] References Cited

U.S. PATENT DOCUMENTS

| | | | |
|---|---|---|---|
| 60,791 | 1/1867 | Rowe | 42/83 |
| 3,451,154 | 6/1969 | Gobie | 42/51 |
| 3,757,447 | 9/1973 | Rowe | 42/51 |

*Primary Examiner*—Charles T. Jordan

*Attorney, Agent, or Firm*—Kolisch, Hartwell, Dickinson & Stuart

[57] ABSTRACT

A nipple usable to ignite a propellent charge in a firearm of the type which employs a percussive firing cap. The nipple includes an elongate body having, adjacent one end, a cap-receiving portion, and adjacent the opposite end, a mounting portion. Extending axially into the nipple, through the cap-receiving portion, is an elongate firing chamber. The outer surface of the cap-receiving portion is dimensioned to receive a firing cap, with the sides of the cap closely confronting such surface. A pair of diametrically opposed ports extend between and open to the firing chamber and to locations on the cap-receiving surface of the nipple, which locations are covered by the sides of the cap when the same is mounted in place.

2 Claims, 4 Drawing Figures

BLACK POWDER FIRING NIPPLE

BACKGROUND AND SUMMARY

The present invention relates to firearms, and in particular to firearms employing percussive caps to ignite a propellent charge.

The percussion firing system was developed early in the 19th century to replace the flintlock method for igniting a propellent charge in a firearm. The basic elements of this system are a percussive firing cap and a nipple communicating with the firearm ignition chamber. The firing cap is designed to fit snugly over the nipple in a position to be struck by the firearm's hammer. When struck, an explosive fulminate in the base of the cap produces a quantity of burning gas in the nipple, and this gas is forced under considerable pressure into the ignition chamber of the firearm, igniting the propellent charge therein.

The above-described nipple has not been entirely satisfactory, in that heated gases from the detonated firing cap tend to blow back in the direction of the cap. Such blow-back adversely affects ignition efficiency, and may present a danger to the firearm user. Blow-back of heated gases may also occur upon ignition of the propellent charge within the firearm ignition chamber, also diminishing the firearm performance.

In the present invention, there is provided a novel nipple in which blow-back of heated gases is controlled so as to reduce the danger to the firearm user and increase the efficiency of ignition of the propellent charge within the gun. The nipple of the present invention includes an elongate body having, adjacent one end, a cap-receiving portion, and adjacent the opposite end, a mounting portion which is used in mounting the nipple on the firearm. An elongate firing chamber extends axially into the nipple through the cap-receiving portion. The outer surface of the cap-receiving portion is dimensioned to receive a firing cap thereon, with the sides of the firing cap closely confronting such surface. A pair of diametrically opposed ports extend between and open to the chamber and to locations on the surface of the cap-receiving portion, which portions are covered by the cap when the latter is received thereon.

Upon ignition of the firing cap, a portion of the pressurized gases within the firing chamber is released through the two port openings, this release tending to deform the sides, or skirt of the firing cap. The energy of the blow-back gases is dissipated principally in the deformation of the firing cap sides, rather than in the blow-back of the cap toward the firearm user. Venting of gases through the nipple port openings during cap firing prevents a discontinuity in the nipple gas pressure, producing a more constant injection of heated gas particles into the firearm ignition chamber.

It is a principal object of the present invention to provide, for use in a firearm of the type employing a percussive firing cap, a nipple which permits release of blow-back gases through side portions thereof.

Another important object of the invention is to provide such a nipple constructed to effect a more even, controlled flow of pressurized gases from the nipple into the ignition chamber of a firearm.

It is yet another object of the invention to provide an improved nipple which may be easily constructed from known, preexisting firearm nipples.

These and other objects and features of the present invention will become more fully apparent when read in relation to the following detailed description of the preferred embodiment of the invention and the accompanying drawings.

DRAWINGS

DETAILED DESCRIPTION OF A PREFERRED EMBODIMENT OF THE INVENTION

Figure 1:
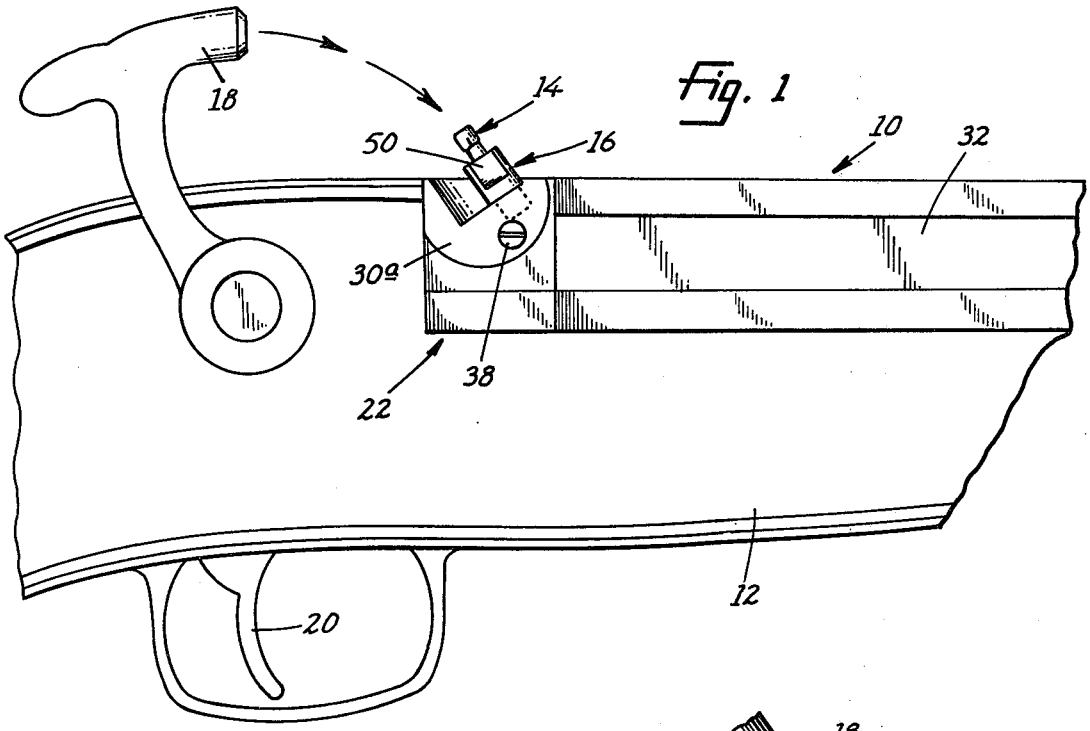
FIG. 1 is a fragmentary side elevation of a percussion cap-ignited firearm employing a nipple constructed in accordance with the present invention.

Referring now to FIG. 1, there is shown at 10 a portion of a firearm 12 employing a percussion-cap firing system for igniting a propellent charge within the firearm. The basic elements of the firing system which utilize a percussion cap such as percussion cap 14, include a nipple 16 constructed in accordance with the invention, and a spring-loaded hammer 18 releasable by a trigger 20.

The firearm includes what is referred to herein as an ignition housing 22 formed of a single piece of cast and machined steel. Housing 22 and nipple 16 are shown in detail in FIG. 2. Considering FIGS. 1 and 2 together, housing 22 is formed with a body portion 24 joined with a threaded fitting portion 26, defining therewithin an ignition chamber 28. Also forming part of the housing is a nipple-mounting portion 30. Fitting portion 26 is threadably attached to barrel 32 of the firearm.

A roughly L-shaped passageway 36 extends through housing 22 externally from a transverse face **30*a* in the nipple mounting portion internally to chamber 28. The outer end of passageway 36 is blocked with a set screw 38, and the inner end of the passageway is reduced to form a port 40 which opens to chamber 28**.

Formed in nipple-mounting portion 30, and extending normal to face **30*a* is a trench 41 defined by intersecting faces 41*a*, 41*b*. Extending normal to face 41*b*, inwardly toward, and opening to passageway 36, is a threaded bore 43, for threadably receiving nipple 16**.

Figure 2:
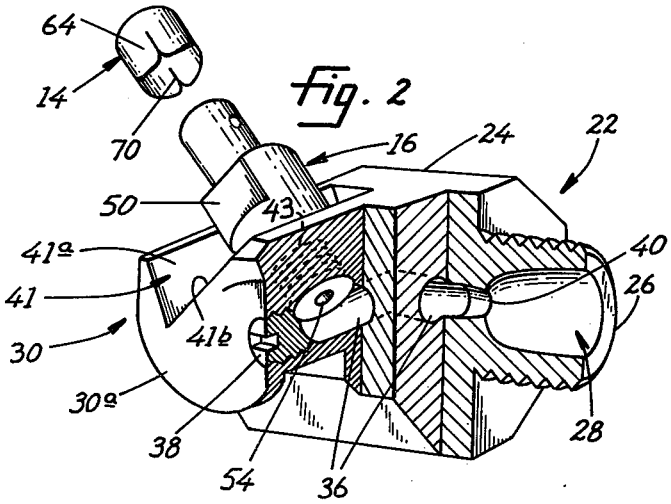
FIG. 2 is an enlarged, removed, cutaway view of an ignition chamber structure of the firearm of FIG. 1 showing the mounting of the nipple, and also illustrating a removed, conventional firing cap.
Figure 3:
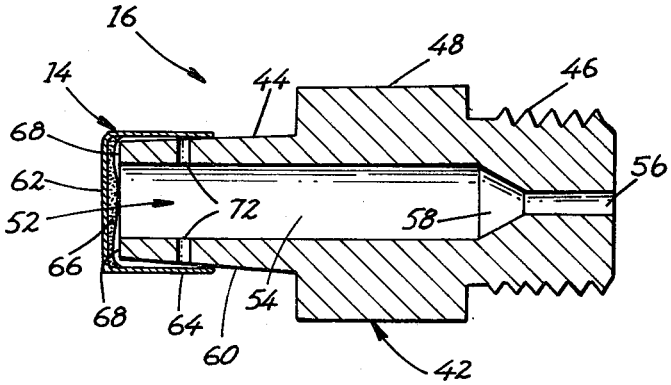
FIG. 3 is an enlarged, longitudinal, sectional view of the nipple of the present invention, and of an attached firing cap.

Viewing the construction of nipple 16 as shown in FIG. 3, the nipple includes an elongate body 42 having, adjacent one end, a cap-receiving portion 44, adjacent the opposite end, a mounting portion 46, and in between these two, a center portion 48. Mounting portion 46 is externally threaded to screw into bore 43. Center portion 48 provides two outwardly facing, parallel-planar surfaces, such as surface 50 (FIG. 2), by which the nipple may be tightened in place.

Extending longitudinally through body 42, and opening to the opposite ends thereof, is a passage 52, including a first larger-bore section 54, a second smaller-bore section 56, and a third intermediate section 58 which is tapered and which interconnects sections 54, 56. Section 54, also referred to herein as a firing chamber, extends axially into the nipple through cap-receiving portion 44, and substantially through center portion 48.

Cap-receiving portion 44 has an outer surface 60 which is slightly tapered, as shown. Surface 60 is dimensioned to receive thereon, in a manner to be described, a percussive firing cap, such as cap 14. With reference to FIGS. 2 and 3, cap 14 is a conventional firing cap having a base 62 formed at one end of a cylindrical skirt 64. A cap charge 66 is placed against the inside of base 62 so as to confront the planar, annular end surface 68 of cap-receiving portion 44 when the cap is placed thereon. Skirt 64 is deformable by virtue of a plurality of slits, such as slit 70, extending from the open end of skirt 64 along a major portion of the cap's axial length. Typically, a cap like cap 14 contains four such slits, spaced apart at 90° intervals.

With particular reference to FIG. 3, there is provided in cap-receiving portion 44, a pair of ports 72 which extend between and open to passage 54 and surface 60. Ports 72 are diametrically opposed and positioned along the axis of nipple 16 to be covered by cap 14 when the latter is placed on the nipple in the manner shown in FIG. 3. Specifically, ports 72 are positioned to be covered by the slitted portion of the firing cap skirt. As will be explained, ports 72 form port means for release of pressurized gases from the firing chamber during cap firing.

In operation, the firearm is prepared for firing by packing a propellent charge such as gunpowder into chamber 28. A firing cap is placed on the cap-receiving portion of the nipple, with the inner surface of the cap's skirt closely confronting surface 60 on the nipple. Hammer 18, when released by trigger 20, strikes the cap, exploding its charge. The exploding cap particles initially expand into section 54, and are momentarily contained there under high pressure. This pressure forces the heated gas particles through sections 58, 56 into passageway 36, and thence through port 40 into ignition chamber 28, where the heated gas particles ignite the propellent charge in the firearm.

Describing first events which occur upon cap firing in nipples known in the prior art, the intense pressure developed within firing chamber 54 acts against the base of the firing cap, tending to displace the cap away from the nipple, against the force of the hammer. As noted above, such blow-back may have two untoward effects. First, pressurized gas released from the cap-receiving end of the nipple may present a danger to the firearm user. Secondly, upon such release, there occurs a discontinuity in the pressure curve of gases being supplied to the ignition chamber through section 56. Such discontinuity may substantially reduce the efficiency of firearm ignition.

Figure 4:
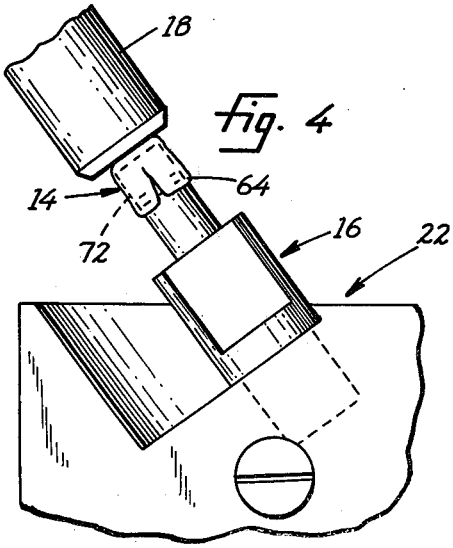
FIG. 4 is an enlarged, fragmentary view of FIG. 1, showing the condition of the firing cap following cap ignition.

From the foregoing, it can be appreciated how the present invention in nipple design substantially reduces the above-described problem in blow-back. Following cap explosion, as gas pressure within chamber 54 increases, a portion of the rebounding gases is forced through ports 72, causing deformation of the firing cap skirt adjacent the two ports, as shown in FIG. 4. Explaining further, pressurized gas escaping through ports 72 causes the slitted portions of skirt 64 to be bent away from the surface of the nipple, to allow for the escaping of gases through the ports. The energy of the blow-back gases then is dissipated partially in deforming the firing cap, rather than through blow-back of gases in the direction of the firearm user. Further, the escape of blow-back gases through ports 72 occurs at a somewhat controlled rate, so that an even pressure curve of heated gases supplying chamber 28 is maintained over an extended period. This acts to improve the efficiency of ignition of the propellent charge within this chamber.

An improved nipple for use in a firearm of the type using a percussive firing cap, which is effective in reducing the problems of blow-back upon cap firing, has thus been disclosed. Various modifications and changes may be made in the above-described nipple design without departing from the spirit of the invention, as set forth in the appended claims.

It is claimed and desired to secure by Letters Patent:

1. A nipple usable to ignite a propellent charge in a firearm of the type which employs a percussive firing cap having a skirt, said nipple comprising an elongate body including, adjacent one end, a cap-receiving portion, and adjacent the opposite end, a mounting portion, means defining a firing chamber extending axially into said nipple from said one end, means defining an outer surface on said cap-receiving portion, dimensioned to receive such a cap thereon, with the cap's skirt closely confronting said surface, and port means extending between and opening to said chamber and to a location on said surface which is covered by a cap received on said cap-receiving portion.

2. In a nipple usable to ignite a propellent charge in a firearm of the type employing a percussive firing cap having a skirt, said nipple comprising an elongate body including, adjacent one end, a cap-receiving portion, and adjacent the opposite end, a mounting portion, means defining a firing chamber extending axially into said nipple through said cap-receiving portion, and means defining an outer surface on said cap-receiving portion dimensioned to receive such a cap, with the cap's skirt closely confronting said surface, port means extending between and opening to said chamber and to a location on said surface which is covered by a cap received on said cap-receiving portion.

* * * * *